US006976649B2

(12) United States Patent
Tisbo et al.

(10) Patent No.: US 6,976,649 B2
(45) Date of Patent: Dec. 20, 2005

(54) HOSE CART WITH EASE OF USE FEATURES

(75) Inventors: Thomas A. Tisbo, Batavia, IL (US); Brian R. Moon, DeKalb, IL (US); Lyle A. Rosine, Batavia, IL (US); Torrence Anderson, Overland Park, KS (US); Michael Uffner, Naperville, IL (US)

(73) Assignee: Suncast Corporation, Batavia, IL (US)

( * ) Notice: Subject to any disclaimer, the term of this patent is extended or adjusted under 35 U.S.C. 154(b) by 0 days.

(21) Appl. No.: 10/701,120

(22) Filed: Nov. 3, 2003

(65) Prior Publication Data

US 2004/0238676 A1 Dec. 2, 2004

Related U.S. Application Data

(63) Continuation of application No. 09/933,232, filed on Aug. 20, 2001, now Pat. No. 6,742,740.

(51) Int. Cl.[7] ..... B65H 75/40
(52) U.S. Cl. ..... 242/395; 242/397.4; 137/355.26
(58) Field of Search ..... 242/395, 397, 242/397.1, 397.2, 397.3, 397.4, 403, 403.1; 137/355.2, 355.26, 355.27

(56) References Cited

U.S. PATENT DOCUMENTS 1,115,325 A * 10/1914 McCall ..... 242/403.1
2,606,067 A * 8/1952 Roark ..... 137/355.2
3,781,738 A * 12/1973 Rozelle ..... 242/397.4
4,767,073 A * 8/1988 Malzacher ..... 242/414
4,897,512 A * 1/1990 Johnston ..... 242/397.3
4,974,627 A * 12/1990 Nelson ..... 137/355.27
5,404,900 A * 4/1995 Fletchall ..... 137/355.27
5,425,391 A * 6/1995 Tisbo et al. ..... 137/355.27
6,050,290 A * 4/2000 Yacobi et al. ..... 242/397.3
6,742,740 B2 * 6/2004 Tisbo et al. ..... 137/355.26
2003/0034417 A1 2/2003 Tisbo et al.

* cited by examiner

*Primary Examiner*—William A. Rivera
(74) *Attorney, Agent, or Firm*—McHale & Slavin, P.A.

(57) ABSTRACT

A hose cart combining the features of an off-set handle, to permit any easier retrieval of paid out hose, a hose tracker, to permit hose to be neatly wound onto a reel, and a storage system comprising a protective housing, to provide storage and protection for a hose kept within, is provided. The invention includes the use of a crank to turn a reel which causes paid out hose to be drawn into the protective box onto a reel. The use of a plurality of gears permits the crank to be offset from the center of the reel, such that it is elevated to a more convenient cranking position. Further, the use of gears permits the same movement of the crank, which causes hose to be collected, causes a hose guide to move laterally, along the axis of the reel, such that hose is neatly layered onto the reel.

14 Claims, 12 Drawing Sheets

HOSE CART WITH EASE OF USE FEATURES

REFERENCE TO RELATED APPLICATIONS

This application is a continuation of application Ser. No. 09/933,232, filed on Aug. 20, 2001 now U.S. Pat. No. 6,742,740.

FIELD OF THE INVENTION

The present invention concerns a novel hose cart, having a protective case and a crank handle elevated from a normal position so as to place the handle at a convenient height and having a mechanical advantage in recovering hose. The hose cart further provides a tracker device that advantageously reels flexible hose neatly upon a reel.

BACKGROUND OF THE INVENTION

Hose carts have been available for much of the second half of the twentieth century, in many shapes and forms and are now typically available, in all such forms, molded of plastic materials. With the increased interest in maintaining and enhancing ones lawn and planting beds, the popularity of hose carts, having means to transport and collect garden hoses, while looking neat and elegant has increased.

Typically, hose carts comprise a hose reel, onto which a flexible garden-type hose is stored. The reel of a typical hose cart generally comprises a central cylindrical hub having elongated flanges at either end of the hub. A hose is wound onto the hub and held between the flanges. The typical hose cart further comprises a handle attached at the center of the longitudinal axis of the hub on one side of the reel and a water input tube placed through the other side of the hub. The hub of such reels is typically between 12 and 18 inches in length, allowing for a large amount of hose to be housed in a relatively small space.

These reels are typically supported by a frame that may either be attached to a wall or to wheels and a handle which allow for mobility; including the ability to move the hose and reel into a structure for aesthetic purposes, during inclement whether or for over-winter storage. Typically, the reel on a mobile hose cart is placed low on the frame, such that it allows clearance of the reel when rotated. Placement of the reel in a low position provides a low center of gravity which helps to keep such hose carts from tipping over when hose is pulled therefrom. Hose reels that are attached to walls are typically attached near the base of the wall so that shrubs or other foundation features may help to hide the hose from view, for aesthetic and security reasons. Many of these types of hose carts are constructed of light-weight plastics formed into structural shapes such that they are strong, durable, light-weight and utilitarian in appearance.

While most present day hose carts basically are of the standard design described above, some modem hose reels and carts have been created that provide a means to hide the sometimes unsightly hose and frame, from view. Such hose carts typically comprises a box shaped housing for enclosing the reel and hose. These types of carts, because of the protective box keep the hose hidden from view and can protect the hose from the elements. As the reel, hose and frame may be protected from the elements, hoses, frames and reels, typically constructed of plastics and rubbers, generally last longer and look good for extended periods of time. These hose carts, which are mostly the identical hose equipment previously described but housed in a protective box, typically suffer from the same deficiencies described above.

In the use of these hose carts, typically hose is paid out by pulling the end of the hose line to a desired length and using the hose in a desired fashion. When use of the hose has finished, the user typically bends down to reach the handle of the cart, turns the handle in such a manner that the reel is rotated in a direction opposite to the pay-out direction, causing the hose to be reeled onto the hose cart. The turning of the handle generally rotates the reel one revolution per complete turn of the handle. Such a rotation returns one segment of typically heavy wet hose to the reel.

Typically, hose returns to the reel hub in a non-directed manner which causes the hose to inefficiently fill the reel space and presents the hose in sloppy manner. Often times the user will use one hand to crank the handle and the other to guide the hose into place, causing the user to soil his hand on wet garden hose that has traversed wet grass or soil. Further, as the user is bent down to reach the handle and has one hand extended to guide the hose, the user may experience discomfort upon the recovery of the entire length of hose.

As a result, hose is often left out, uncollected, providing an unsightly and sometimes dangerous hazard. Hose, which is traditionally the color of grass, left off of a reel can be a tripping hazard, typically is unhealthy for the grass that is strewn upon, allows the hose to be deteriorated by the damaging effects of the sun (including heat and damaging sun light) and can allow the hose to fall prey to lawn and garden equipment inadvertently run over hose that is camouflaged by the lawn.

SUMMARY OF THE INVENTION

In accordance with the present invention, a hose cart comprising a reel for holding a flexible hose, a handle adjacent the reel, and gears, rotationally connecting the handle and the reel, such that the turning of the handle provides a mechanical advantage in the rotation of the reel, are provided. In the preferred embodiment of the present invention, a mechanical advantage is 2:1 is created by the gearing of the handle and the hose reel. It is to be understood, that any ratio of mechanical advantage may be achieved, using gears of different and varying sizes, without departing from the novel scope of the present invention.

In the preferred embodiment of the present invention, the reel defines an axis and the gears, of the handle and the reel, allow the handle to be placed above the axis of the reel, to alleviate the need for much of the bending generally required in the use of hose reels. In the preferred embodiment, the handle may be placed between 5 and 6 inches above the axis of the reel. It is to be understood, that the handle may be placed higher or lower, with respect to the reel, without departing from the novel scope of the present invention.

In the preferred embodiment, of the present invention the gears comprise a first gear attached to the handle, a second gear attached to the reel and an idler gear between the first gear and the second gear.

The idler gear allows for the appropriate separation between the reel axis and the handle so as to be able to raise the handle to an appropriate location to lessen the degree of bending necessary for use of the hose cart.

In one embodiment of the present invention a hose tracking assembly is provided, in mechanical connection with the handle, to take-up a hose such that the hose may be neatly placed along the length of the reel. A tracker device, which holds a hose generally perpendicularly to the hose's long axis, rides upon a double helix gear which is in direct mechanical communication with the handle and reel, such that the rotation of the handle causes both the rotation of the reel and the rotation of the double helix gear, allowing the tracker to move first in one direction, up to the end of the reel and then in the opposite direction, along the length of the double helix gear, allowing the deposition of a hose in an orderly fashion across the entire length of the reel. The double helix gear, in combination with the tracker device, allows sections of the hose to be laid evenly on the reel, rather than on one place as on prior reels without tracking devices.

In a preferred embodiment of the present invention, the reel, tracker, gears and associated equipment are provided in an enclosed housing that protects the mechanisms and a large supply of hose, as well as provides storage for watering related equipment. In a preferred embodiment, the lid of the enclosed housing pivots upwards on special hinges which provide a means to lock the lid in an open position to allow the user access to the interior of the housing. In one embodiment, an equipment caddy is provided, beneath the lid, to allow easy access to associated watering equipment.

A more detailed explanation of the invention is provided in the following description and claims and is illustrated in the accompanying drawings.

DETAILED DESCRIPTION OF THE ILLUSTRATIVE EMBODIMENT

Figure 1:
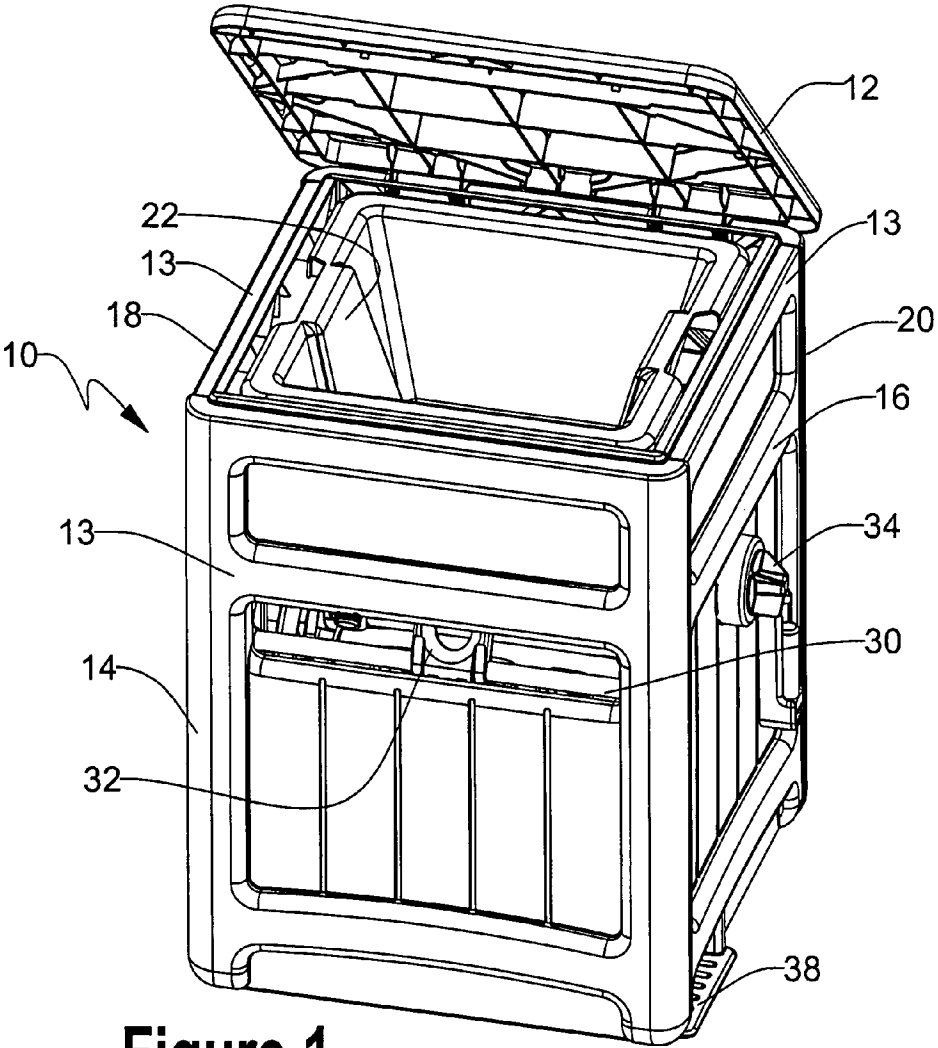
FIG. 1 is a perspective view of a hose cart of the present invention, having a tool storage member inside and accessible through a top lid.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of an Illustrative Embodiment") relates to a requirement of the United States Patent Office, and should not be found to limit the subject matter disclosed herein.

Referring to the drawings, a hose cart 10 having a lid 12, and walls 13, namely a front wall 14 a first side wall 16, a second side wall 18 and a rear wall 20, is provided. A tool container 22 is shown in place within walls 13, resting on lip features 24 of each of walls 13. Tool container 22 is easily removable from hose cart 10, typically providing some access to a hose reel 26 (FIG. 6) and a hose (not shown) which may be reeled upon reel 26, contained therein. It is to be understood that tool container 22 is provided as an extra feature, for the convenience of the user of hose cart 10, and may or may not be included as an accessory, without departing from the novel scope of the present invention.

Figure 2:
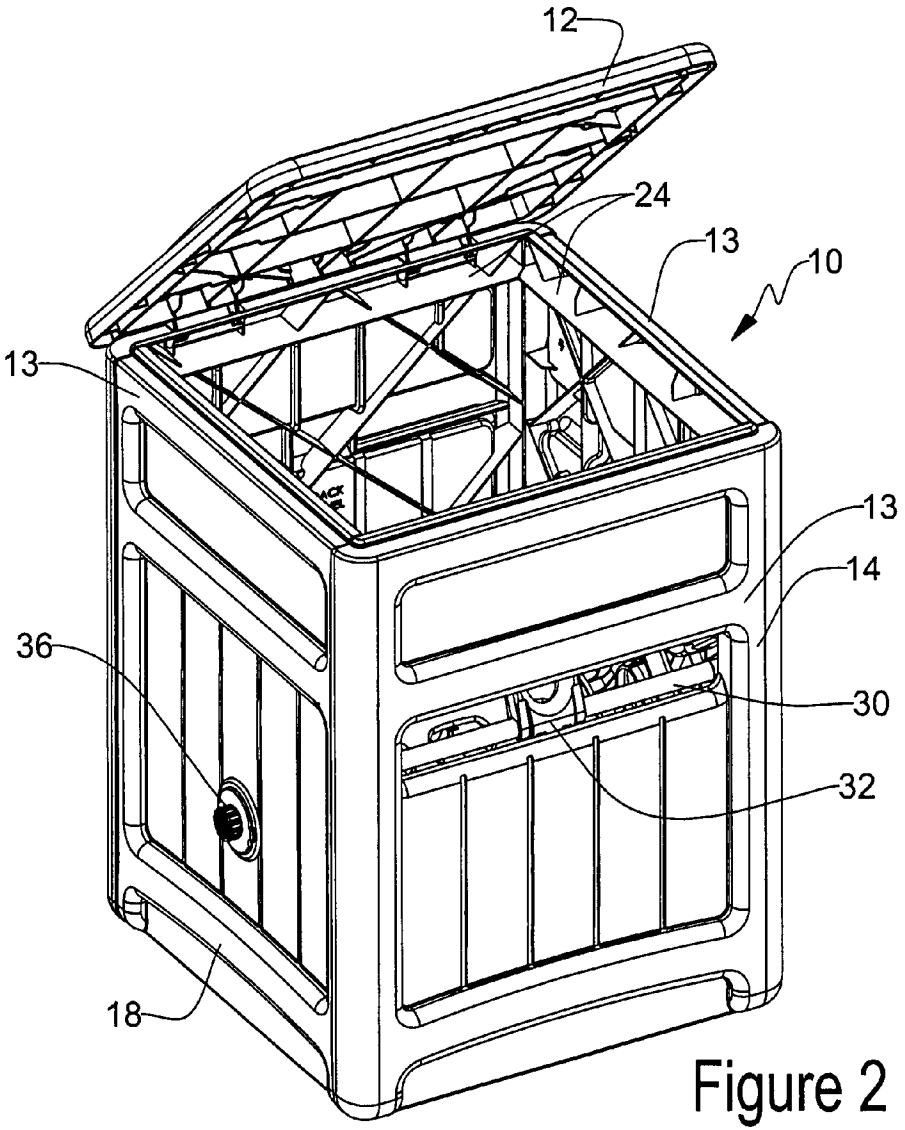
FIG. 2 is a perspective view of a hose cart of the present invention showing hose attachment piece and the hose payout section.
Figure 3:
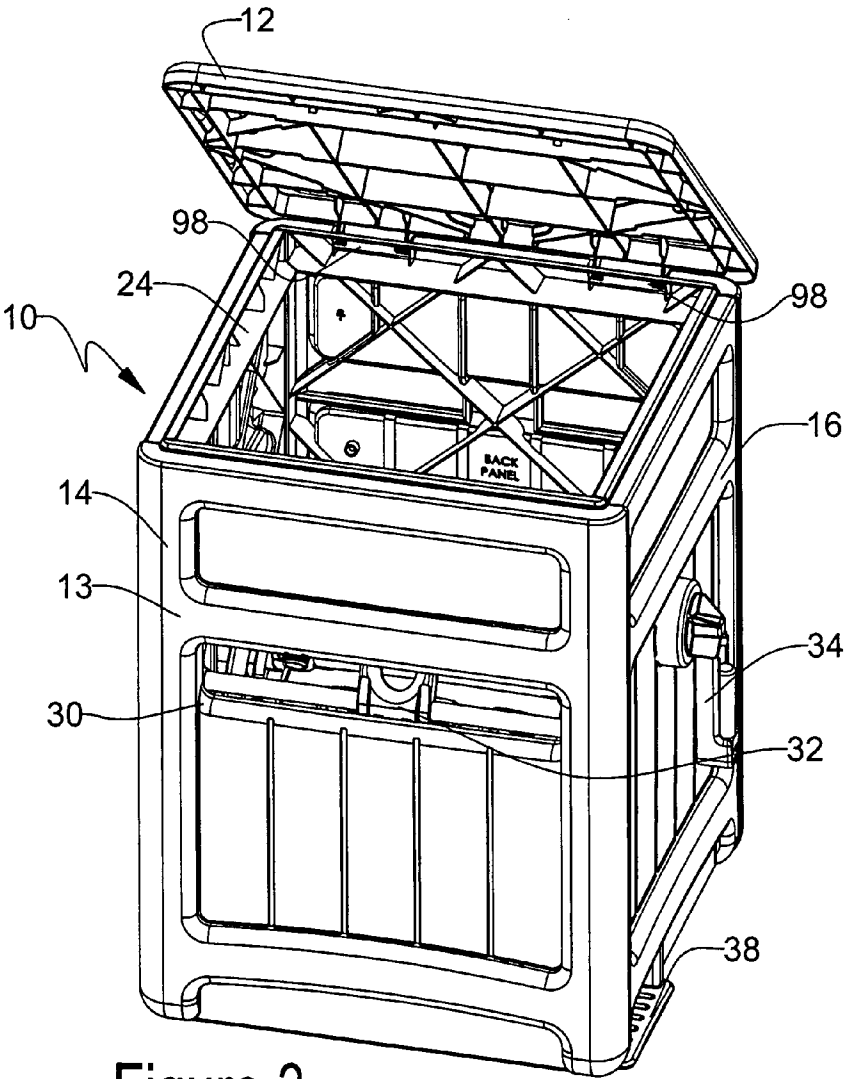
FIG. 3 is a second perspective view of the hose cart of FIG. 2, showing a hose winding apparatus and the hose payout section.
Figure 4:
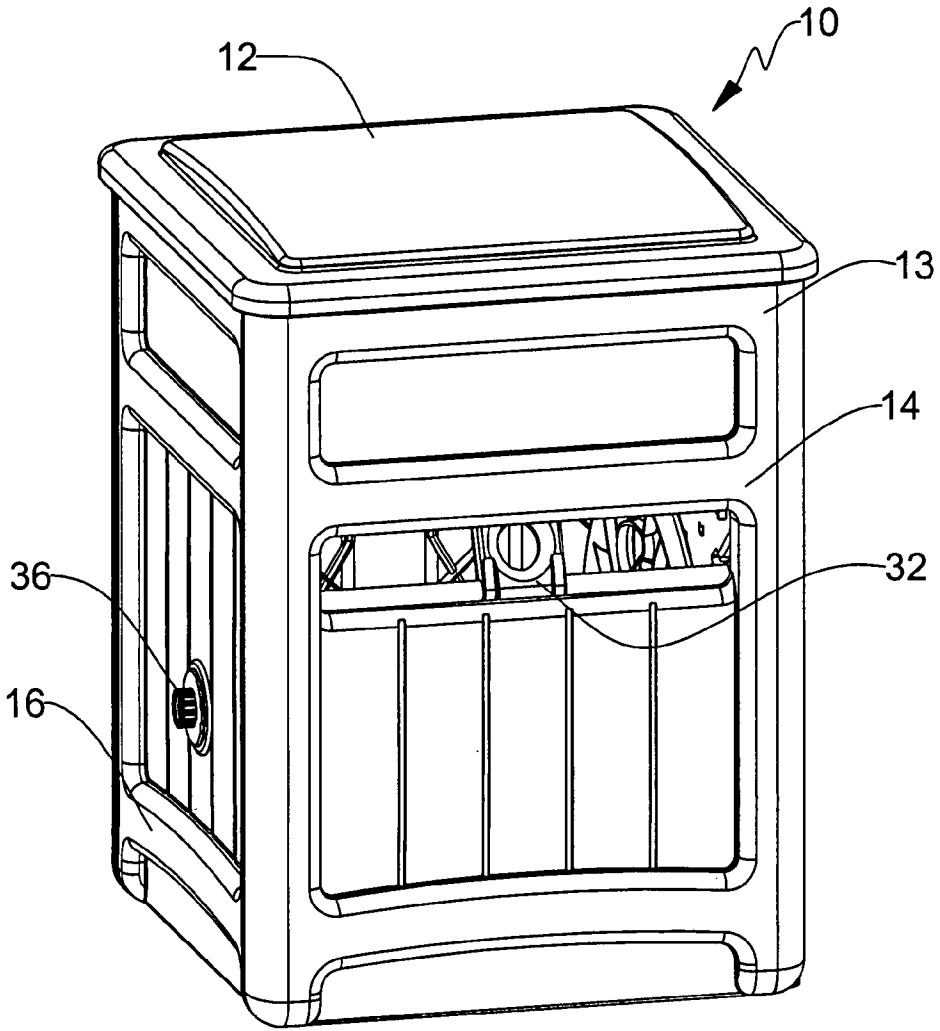
FIG. 4 is a perspective view of the hose cart of FIG. 2, showing the hose cart with a closed lid.
Figure 5:
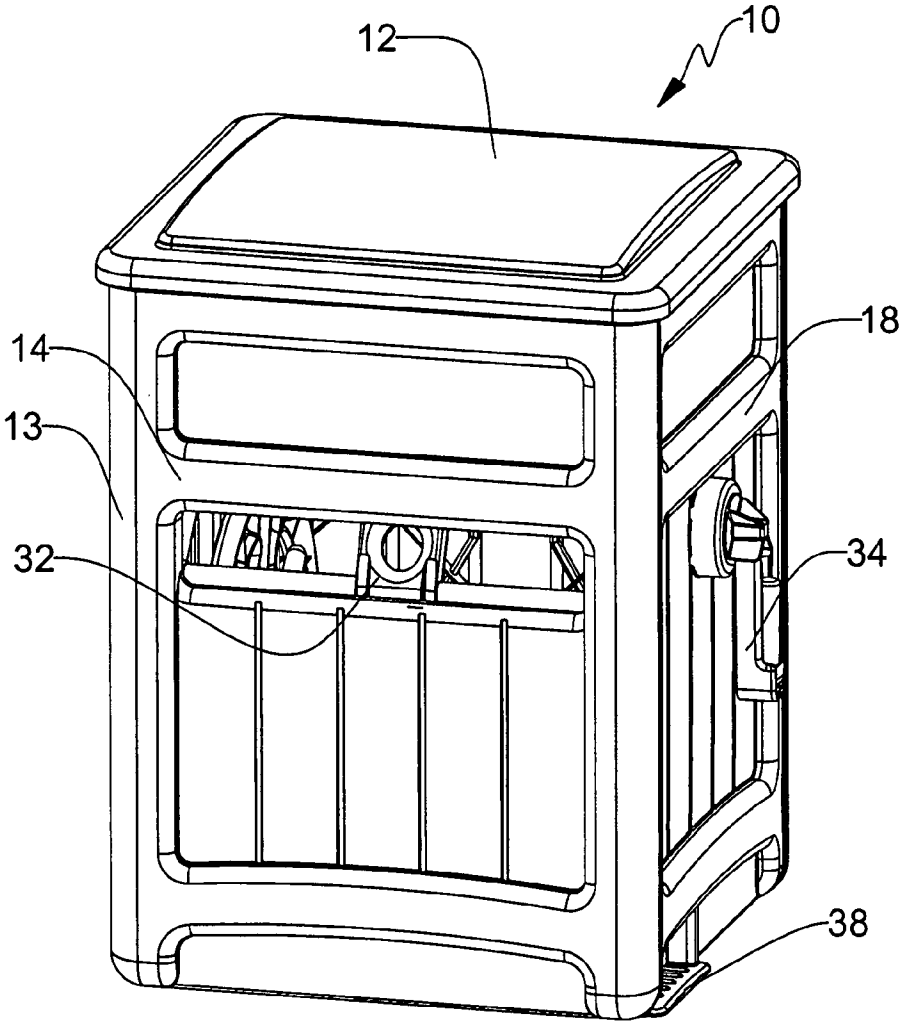
FIG. 5 is a perspective view of the hose cart of FIG. 3, showing the hose cart with a closed lid.

A hose window 30, which provides a means for paying a hose out of hose cart 10, and subsequently retrieving the hose, is provided at about the level of reel 26. As can bee seen in FIG. 1, a tracker body 32 is visible through window 30. Tracking body 32, which will be described in greater detail below, provides a means of neatly winding a hose onto reel 26. Hose cart 10 further comprises a crank or handle 34, to allow the turning of reel 26 both for paying out a hose and for reeling in a hose, as will be described in greater detail below, and a hose connection port 36, as seen in FIG. 2, through which the hose within hose cart 10 may be connected to a water spigot or other water connection point. It will be understood, by those having ordinary skill in the art, that the locations of crank 34 and port 36 are interchangeable and each may be located on different walls than shown without departing from the novel scope of the present invention.

Hose cart 10 comprises a stabilizing pedal 38, which allows the user to steady cart 10 while using crank 34 to rotate reel 26. Cart 10, further, comprises a number of design and structural elements on its surface and in the shapes of the plastic members used, to provide strength, stability and aesthetics. It will be understood by those having ordinary skill in the art that any number, shape or form of these structural and aesthetic features may be utilized without departing from the novel scope of the present invention. Further, hose cart 10 comprises at least two wheels 35 to allow for the easy movement and placement of hose cart 10. It will be understood that hose cart 10 may be provided with any number of wheels to assist the user of the cart with moving and positioning the cart 10 without departing from the novel scope of the present invention.

Figure 6:
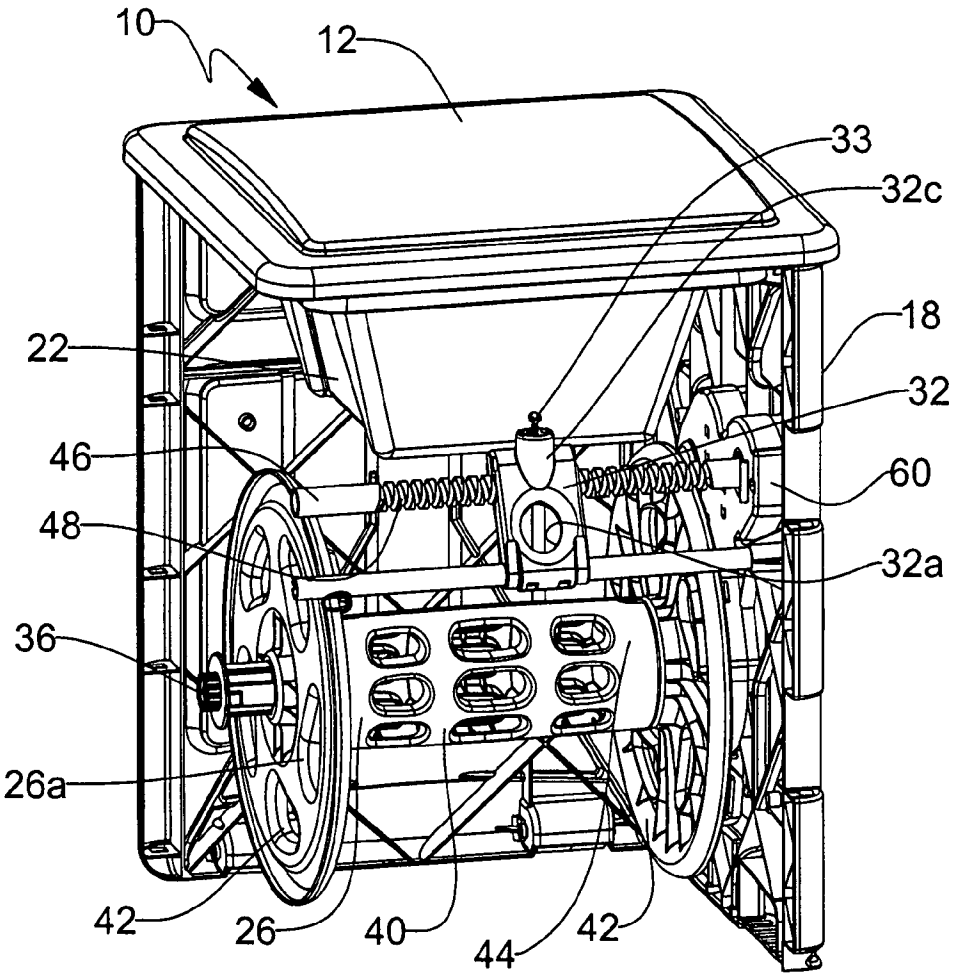
FIG. 6 is a partially broken away perspective view of the hose cart of FIG. 5.
Figure 7:
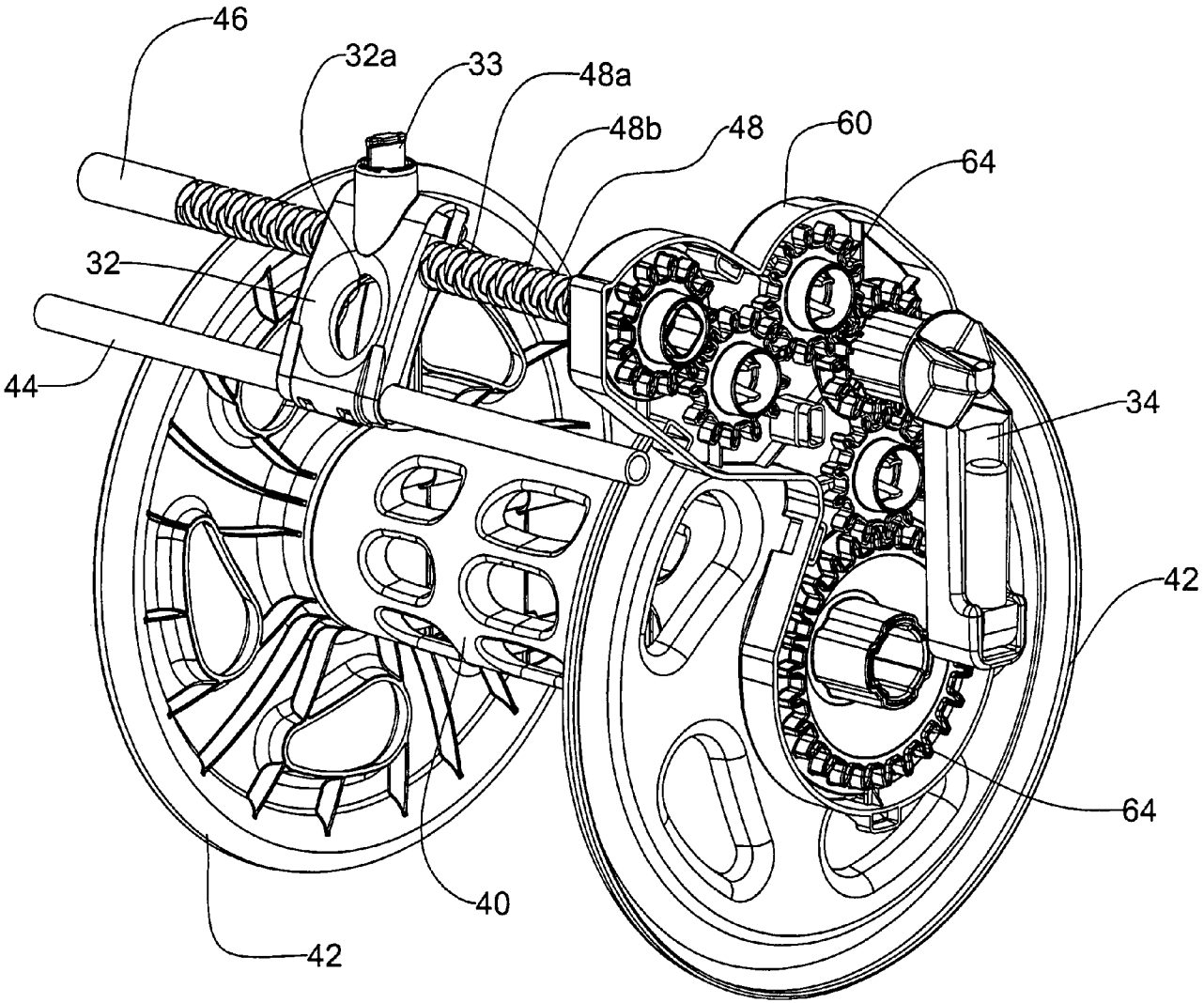
FIG. 7 is a perspective view of a hose reel and concomitant gears of a hose cart of the present invention.
Figure 9:
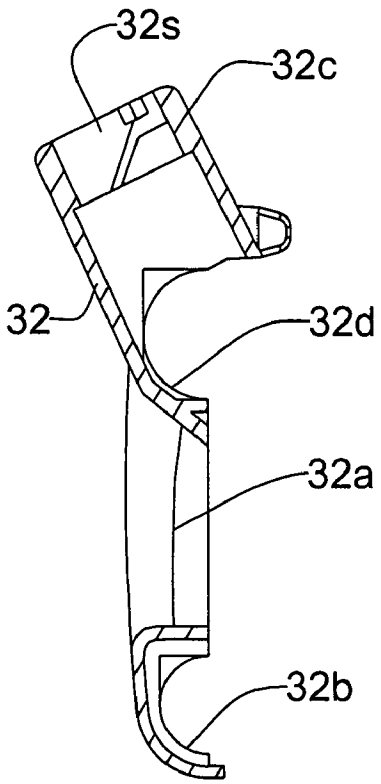
FIG. 9 is a cross-sectional view of the tracking mechanism of FIG. 8 taken along the line 9—9 of FIG. 8.

Referring now to FIGS. 6 and 7, a more detailed view of the interior of hose cart 10 is shown. As can be seen, in FIG.

6, hose port 36 is attached at the hub 26*a* of reel 26. While port 36 is attached at hub 26*a*, so as to allow an element of the port to rotate freely with reel 26, it will be understood, by persons having ordinary skill in the art, that port 36 may be connected in a variety of manners, including the connection of a swivel mechanism to a hub portion of reel 26 (such as hub 26*a*) while maintaining a connection portion of port 36 at a separate location, and other means and manners of connection, without departing from the novel scope of the present invention. As shown in FIG. 6, reel 26 comprises a hub section 40 between two flange sections 42. Typically, a hose will be reeled upon hub section 40 and will be held in place by flange sections 42.

Figure 8:
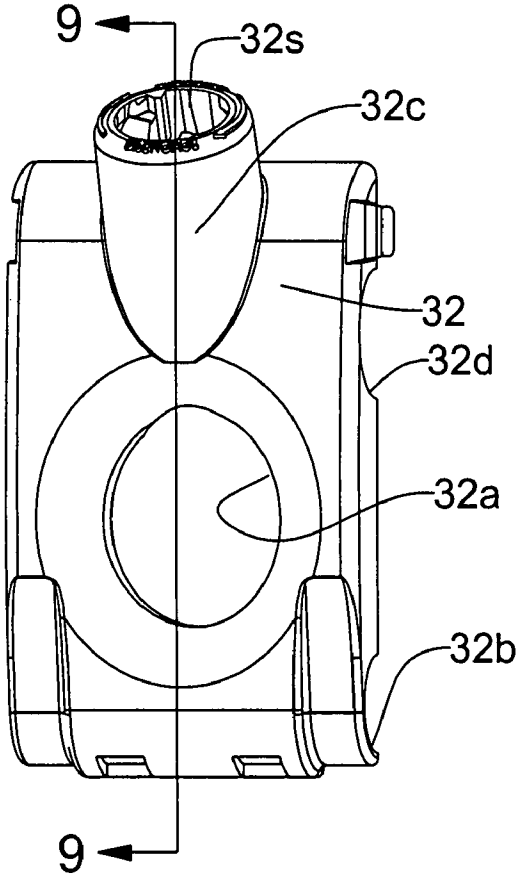
FIG. 8 is a perspective view of a tracking mechanism of the present invention.

Referring now to FIG. 8, tracker body 32 defines a hose guide 32*a*, through which any one of a large variety of different diameters of hose may be threaded. It will be understood, by persons having ordinary skill in the art, that the present invention may be adapted so as to accommodate any type, size and diameter flexible hose or tube member, without departing from the novel scope of the present invention.

As seen in FIGS. 6 and 7, that cart 10 is provided with a ride stabilizing rod 44 and a tracking rod 46. Rod 44 may be attached in any number of ways at or near walls 13 of cart 10. Rod 46, in the present invention, is attached, at each end, near walls 13 of hose cart 10, so that it may rotate about its longitudinal axis. A more detailed explanation of the attachment of rod 46 will be provided below. It will be understood, by persons having ordinary skill in the art, that stabilizing rod 44 may be attached so that it is either fixed, or so that it may be caused to rotate about its longitudinal axis, without departing from the novel scope of the present invention. Stabilizing rod 44 in the present invention, which is generally parallel and adjacent to tracking rod 46, assists in keeping a tracking mechanism, which travels laterally along tracking rod 46, from rotating, perpendicular to the direction of travel, about tracking rod 46.

Rod 46 further comprises a tracker screw 48. Tracker screw 48, in the present embodiment, comprises a double helix screw pattern formed into or onto rod 46. Tracker screw 48 includes two grooves, 48*a* and 48*b*, connected near both ends of rod 46 and criss-crossing along the length of rod 46. One of the two grooves, 48*a* or 48*b*, is a right-handed groove and the other is a left-handed groove. In this manner, and in association with means which will be identified and described in greater detail below, tracker body 32 can traverse the length of rod 46 in a first direction along the longitudinal axis of rod 46, and subsequently, in the opposite direction.

It will be seen, with reference to FIG. 8, that tracker body 32 further comprises a stabilizing-rod guide flange 32*b*, which, when tracker body 32 is in its operating position, is adjacent to stabilizing rod 44. Tracker body 32 further comprises a tracker follower guide 32*c*, which will be explained in greater detail below, and a tracking rod guide flange 32*d*, which, when tracker body 32 is in its operating position, is adjacent to tracking rod 46. Flanges 32*b* and 32*d*, particularly flange 32*b*, are provided to assist in providing lateral movements of tracker body 32 without permitting unwanted rotation, as described above, of a tracker mechanism perpendicular to the desired direction of movement.

Figure 11:
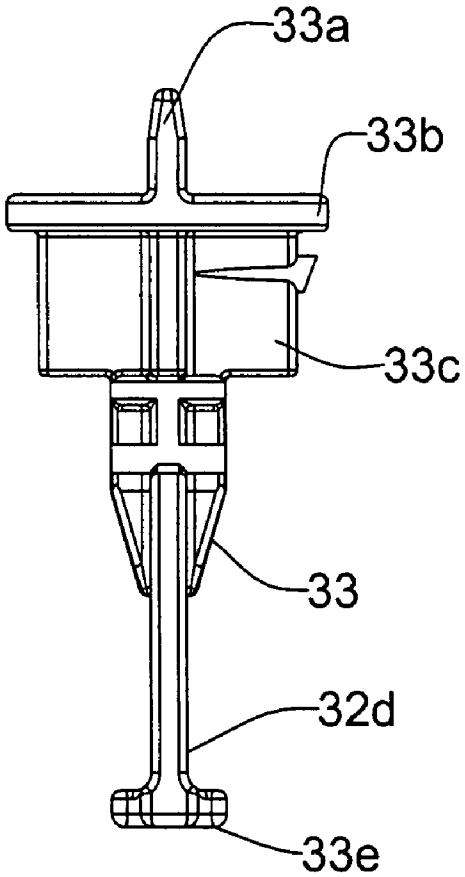
FIG. 11 is a side plan view of the tracker follower of FIG. 10.
Figure 10:
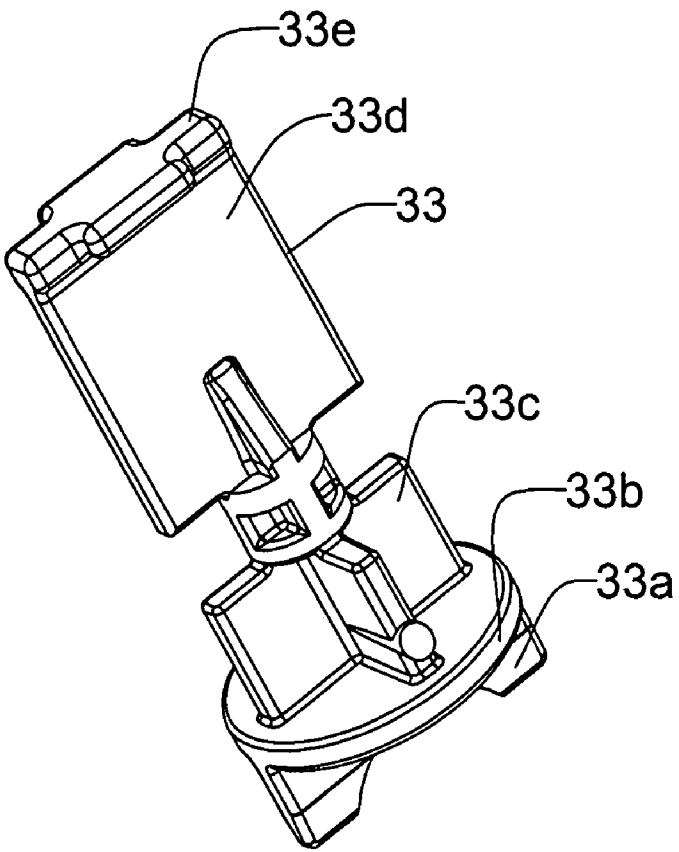
FIG. 10 is a perspective view of a tracker follower mechanism of the present invention.
Figure 13:
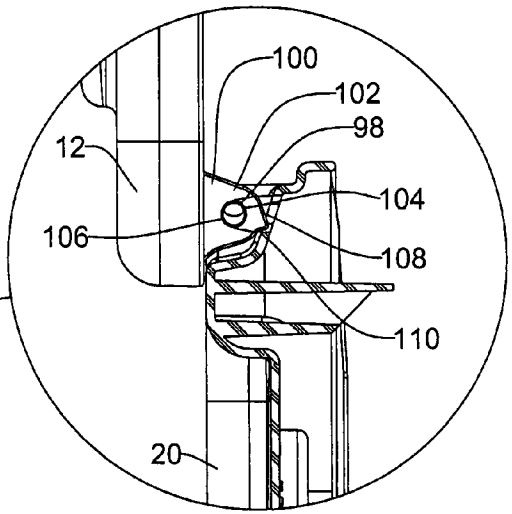
FIG. 13 is a cut away view of the hinge feature shown in FIG. 12.

Referring now to FIGS. 10 and 11, a tracker follower 33 is shown. Tracker follower 33 is generally a key-like device that allows tracker body 32 to engage tracking screw 48 on rod 46. Engagement of tracker body 32 to tracking screw 48 allows the above described lateral movement of tracker body 32. Tracker follower 33, in the present embodiment, comprises a handle 33*a*, a guide cover 33*b*, shown as a disk shaped lid, a first upper flange 33*c*, a second lowed flange 33*d* and a tracking foot 33*e*. It can be seen that tracker follower 33 can be inserted into tracker body 32, into tracker follower sleeve 32*s*, so at to allow engagement of tracker body 32 with tracking rod 46 and tracker screw 48. It will be understood, by those having ordinary skill in the art, that the placement of tracker follower 33 into follower guide 32*c* may be made in a number of different ways. Further the use of tracker followers and guides of a variety of shapes and sizes, all of which provide a means to allow a hose guide to engage a screw-type gear so that hose fed in can be neatly placed, layer by layer, onto a reel, can be used without departing from the novel scope of the present invention. Further, it will be understood by persons having ordinary skill in the art, that follower 33 may be maintained in sleeve 32*s* by any number of means known in the art, including a spring to bias follower 33 onto screw 48 or by key patterns which allow a user to slide follower 33 into sleeve 32*s* and, by rotating follower 33, lock it into place. All such means and methods of maintaining follower 33 in association with screw 48 are contemplated and are not a departure from the novel scope of the present invention.

In the present embodiment, tracker follower 33 is generally key-shaped and the tracker follower sleeve 32*s* is generally lock-shaped. In this manner, a user may remove follower 33 from sleeve 32*s*, as one would remove a key from a lock, so as to disengage the tracker mechanism of the present invention. Further, once in place, follower 33 may be turned within sleeve 32*s* to change the direction of travel of tracker 32. This is accomplished as a result of the shape of tracking foot 33*e*, which is designed such that it will fit in only one of the right-hand groove or the left hand groove, 48*a* and 48*b*, of tracking screw 48, at a time. In a preferred embodiment, tracker follower 33 is molded as a single piece. In this manner the tracker assembly is easier to assemble and more ergonomic to handle and use. It will be understood by persons having skill in the art, that tracker follower 33, as well as the tracker assembly may be constructed in a number of pieces and by any number of processes, including molding, cutting, and other methods of forming known in the art, without departing from the novel scope of the present invention.

As will be explained in greater detail below, when crank 34 is turned rod 46 is, through a series of interconnected gears 64 (FIG. 7), which will be described below, caused to turn and which rotates tracker screw 48. When tracker follower 33, through foot 33*e* is engaged with screw threads 48 and crank 34 is turned, tracker body 32 is caused to move transversely along rod 46, in such a manner that a hose, engaged therewith, in opening 32*a*, is caused to move laterally while being collected on reel 26. Such a manner of use causes hose to be collected neatly onto reel 26.

Therefore, when follower 33 is inserted into sleeve 32*s* the user may turn handle 33*a* such that foot 33*e* engages a right-hand groove opening in screw 48 causing tracker 32, and a hose threaded there through, and attached to reel 26, to travel to the right. Similarly, a user may engage foot 33*e* into a left hand groove of screw 48 and cause tracker 32 and a hose to travel to the left.

As a result of the manner in which the double helix pattern on screw 48 is crisscrossed, it will be understood that when foot 33*e* reaches the end of rod 46, foot 33*e* will be transferred from, for example, the right-hand groove to the left hand groove, causing the tracker to reverse direction and track back across rod 46 towards the other end of hose cart 10. This manner of movement of tracker 32 can continue until all of the paid-out hose is recovered, or until tracker 33 is removed or otherwise disengaged from follower 32. It will be understood, by persons having skill in the art, that a user may cause, at any point along the length of rod 46, foot 33*e* to be moved from its current groove to an oppositely directed groove, and thereby change the direction of tracker 32 (and the manner in which hose is laid onto reel 26). In this manner, hose may be layered in a desired fashion other than a traditional end to end layering.

It will be seen, in FIGS. 6 and 7, that hose cart 10 includes a gear box 60 adjacent to the interior side of wall 18. As more clearly seen in FIG. 7, gear box 60 comprises a protective cover 62 which is formed to house a number of gears 64. As will be understood, by persons having ordinary skill in the art, gears 64 are provided for at least three purposes in the embodiment of the present invention illustrated in FIG. 7. Gears 64 provide for the rotation of reel 26, and for the rotation of rod 46 and for the off-centered placement of crank 34. As such a turn of crank 34 causes the rotation of reel 26 and causes traveler 32 to move laterally along the axis of rod 46. It will be understood, by persons having ordinary skill in the art, that the gear ratios of gears 64 and screw 48 maybe adjusted so that a rotation of reel 26 corresponds exactly with a lateral movement of traveler 32 such that a single layer of hose is deposited in a compact and exact manner onto one segment of reel 26. It will be understood by persons having ordinary skill in the art that gear rations and screw patterns may be changed so that hose is deposited in any manner desired onto reel 26, without departing from the novel scope of the present invention.

Further, gears 64 may be of a variety of sizes and tooth patterns, as will be known by persons having skill in the art, such that the rotation of crank 34 may be made to cause variable rotations of reel 26 and rod 46 such that the laying of hose is made as desired. Further, it will be understood that gears 64 may be such that a single rotation of crank 34 can cause a multiple rotation of reel 26, in this manner an advantage may be had that allows a user to exert less force than required in a prior art hose reels. Further still, the use of multiple gears 64 allows for the placement of crank 34 off center, and desirably at a higher level than typically found in hose reel assemblies. As such, a user of hose cart 10 of the present invention may recover paid out hose without the degree of bending typically required in hose cart assemblies.

In the preferred embodiment of the present invention, a gear ration of two to one, allowing the user to exert half as much force as typically required in hose carts of the prior art. Further, in the preferred embodiment, the placement of gears 64 allows crank 34 to be placed off-set from the center of the reel, as typically cranks are placed, such that the placement may be at a higher level above the ground, allowing the user to stand typically more erect, bending less, when recovering paid-out hose. In a preferred embodiment, the gear sizes are such that the crank is set 5½ inches higher than the central axis of reel 26. Further, the use of multiple gears 64, allows the present invention to be assembled using no pulleys, bands or chains which allows for a more durable and maintenance free hose system.

In the operation of hose cart 10 of the present invention, a garden type hose is threaded through an opening 32*a* in a hose tracker body 32 and is attached, so that the hose may be connected to a source of water and so that the hose may be collected on reel 26, in a manner generally used in hose carts. A handle 34, attached to a gear box 60, having therein a plurality of gears 64, attached such as to allow for the driving of a reel 26, a tracking rod 46 and a tracker body 32 while allowing handle 34 to be offset from the center of reel 26 in a more comfortable raised position, is then rotated causing the hose to be drawn into hose cart 10. Rod 46, which has a double helix tracking screw 48 thereon, engages tracker body 32 through a tracker follower 33, causing tracker body 32 to move laterally along rod 46 as handle 34 is turned. When follower 33 reaches the end of rod 46, it is caused to join the reverse screw of the double helix tracking screw 48 and move in the opposite direction. In this manner, as handle 34 is rotated, drawing hose onto reel 26, tracker body 32 deposits the retrieved hose neatly along the body of reel 26 in even layers. As such, the hose cart of the present invention can typically house more hose than a same sized reel without a tracking mechanism.

Figure 12:
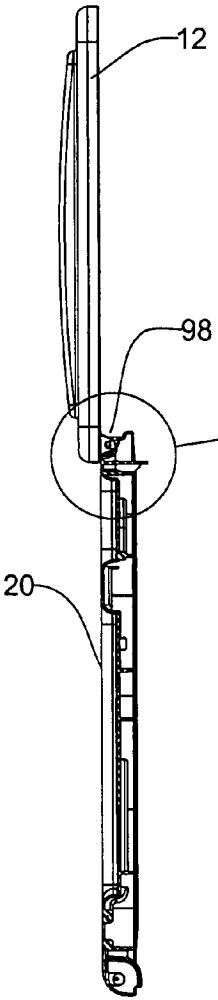
FIG. 12 is a cut-away view of the rear wall of a hose cart of the present invention with a plan view of the lid of a hose cart of the present invention in opened-hinged communication therewith.
Figure 15:
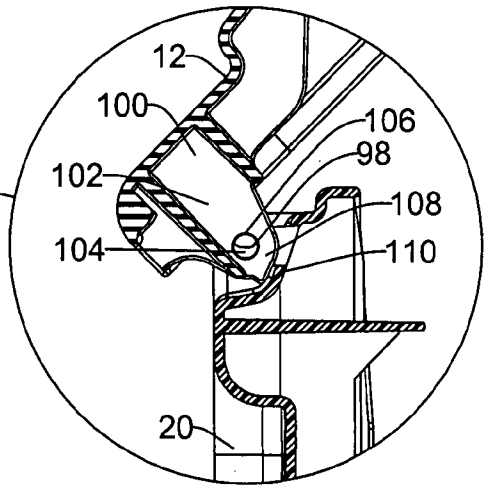
FIG. 15 is a cut away view of the hinge feature shown in FIG. 14.
Figure 14:
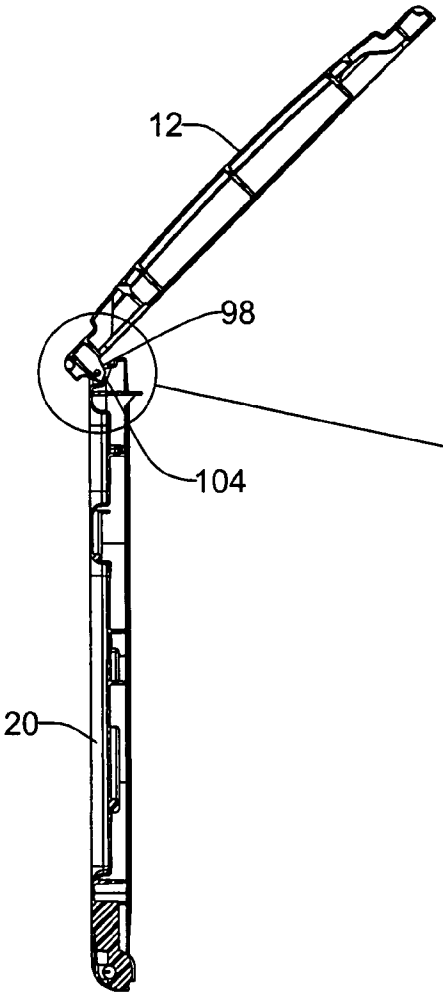
FIG. 14 is a cut-away view of the rear wall and lid of a hose cart of the present invention in a partially opened-hinged communication therewith.
Figure 17:
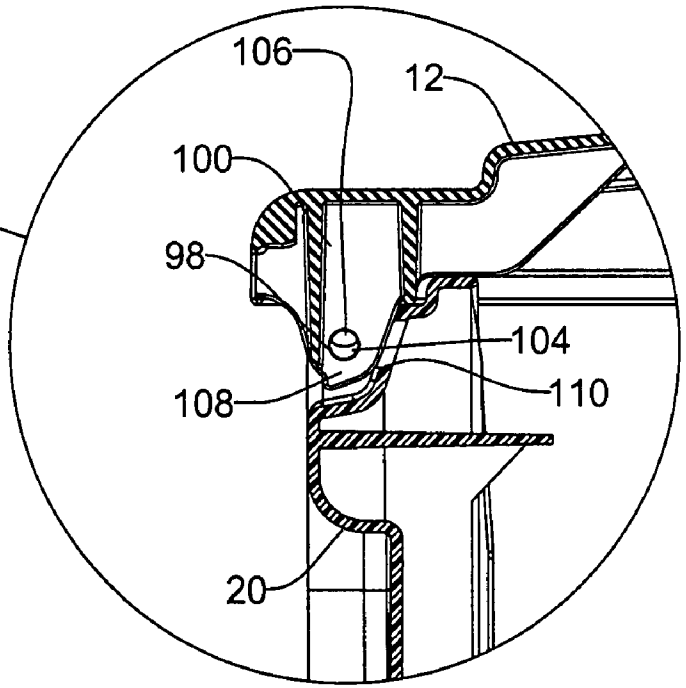
FIG. 17 is a cut away view of the hinge feature shown in FIG. 16.
Figure 16:
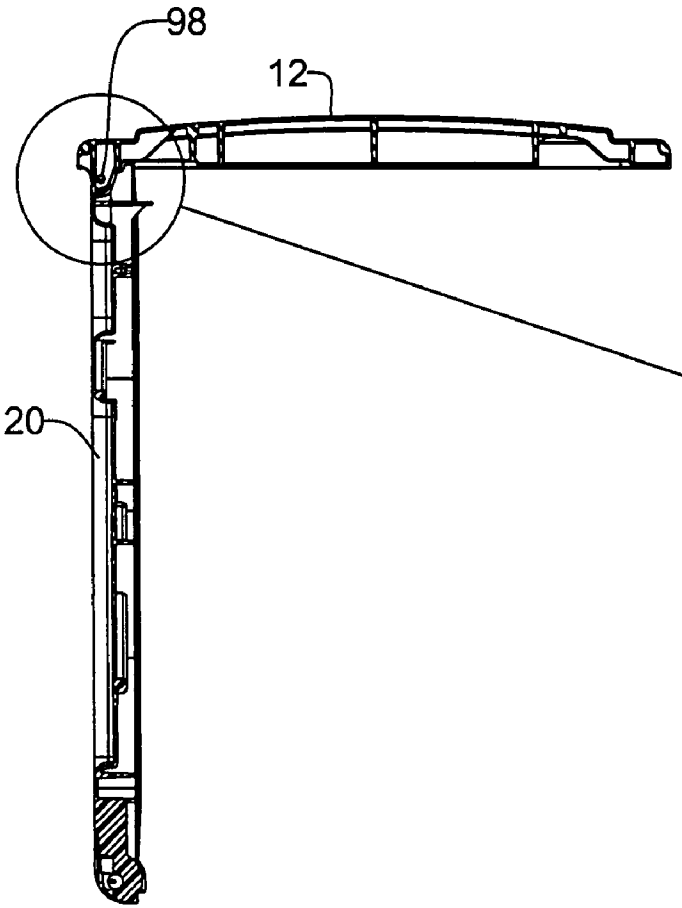
FIG. 16 is a cut-away view of the rear wall and lid of a hose cart of the present invention in closed-hinged communication therewith.

Referring now to FIGS. 12 through 17, a novel lid, providing a means to maintain the hose cart 10 in an open position is shown. As will be seen, lid 12, in a preferred embodiment, is provided with a pair of hinges 98 to allow lid 12 to be opened to allow access to the interior of hose cart 10. A lid stay-open feature 100 is provided on lid 12 to allow lid 12 to remain open when desired. As shown in FIGS. 12, 15 and 17, hinge arm 102 is provided to connect lid 12 to rear wall 20. Hinge pin 104 is fit into a socket 106, in such a manner as to allow slight lateral movements of hinge pin 104 within socket 106, such that lid 12 may slightly pivot, at the axis of rotation of hinge pin 104. An extended lip segment 108 is provided such that it may interact with a lip flange 110 as lid 12 is opened on rear wall 20. When lid 12 is rotated open on hinge pin 104, and lid 12 is pivoted up, extended lip segment 108 may be placed such that it rests at the end of lip flange 110. In this manner, lid 12 may remain open. FIGS. 14 and 16 show hinge pin 104, attached to lid 12 and rear wall 20, in various stages of closing, with FIGS. 15 and 17 showing the entire lid 12 in concomitant stages of closure. It will be understood by persons having ordinary skill in the art that the hose cart 10 of the present invention may be constructed such that lid 12 hinges onto anyone of the walls of cart 10, may be hinged so that lid 12 is a two piece lid with each piece being attached at two opposing walls such that one or both parts of lid 12 may be opened (leaving the other part closed or allowing the opening of both parts without creating one large open lid) or that cart 10 may be made without the means to maintain lid 12 open, all without departing from the novel scope of the present invention. It will also be understood that while a two piece hinge is shown and described, the substitution of any number of hinge elements or a single hinge traversing the entire lid of the hose cart of the present invention, may be used without departing from the novel scope of the present invention.

Although an illustrative embodiment of the invention has been shown and described, it is to be understood that various modifications and substitutions may be made by those skilled in the art without departing from the novel spirit and scope of the invention.

What is claimed is:

1. A hose reel cart having a remote reel crank mounted in an upper portion of a container to allow rotation of a hose storage reel from an elevated position, said hose reel cart comprising:

a pair of side wall members;

a rotatable spool assembly located between said pair of side wall members, said spool assembly operably connected thereto for rotation of said spool about an axis of rotation;

a handle assembly being outwardly and rotatably secured to an upper portion of one of said side wall members;

a first gear train secured to said one of said side wall members, wherein said first gear train includes a handle gear secured to said handle assembly to be rotatable therewith, at least one idler gear rotatably secured to said side wall member about a second axis of rotation and being positioned in engagement with respect to said handle gear to be rotatable responsive to rotation thereof, and a spool gear coupled to said spool to be rotatable therewith and being positioned in engagement with respect to said at least one idler gear to be rotatable responsive to rotation thereof, wherein said at least one idler gear rotatably secured at a position above said axis of rotation and said handle gear is rotatably secured at a position above said idler gear axis of rotation;

wherein said at least one idler gear provides for the appropriate separation between said axis of rotation and said handle assembly to facilitate mounting said handle assembly in said upper portion of said side wall member; wherein operation of said first gear train via said handle assembly from said elevated position provides rotational movement of said spool.

2. The hose reel cart in accordance with claim 1 wherein said first gear train includes a plurality of idler gears, wherein each of said plurality of idler gears are spaced and vertically positioned along said one side wall member to facilitate mounting said handle in an elevated position with respect to said spool axis of rotation, wherein each of said plurality of idler gears are positioned in engagement with respect to an adjacent idler gear to be rotatable responsive to rotation thereof.

3. The hose reel cart in accordance with claim 1 wherein said hose reel cart includes a tracking assembly suitably supported between said pair of side wall members and a second gear train positioned within at least one of said side wall members, wherein said second gear train is in mechanical engagement with said spool assembly, wherein said second gear train includes at least one idler gear, wherein said at least one idler gear is positioned in engagement with respect to said handle gear to be rotatable responsive to rotation thereof, a tracking screw gear secured to a tracking screw to be rotatable therewith, said tracking screw gear being positioned with respect to said at least one idler gear to be rotatable responsive to rotation thereof, wherein said at least one idler gear provides for the appropriate separation between said axis of rotation and said tracking assembly to facilitate mounting said tracking assembly a suitable distance from said reel assembly to facilitate take up of said flexible elongate member, wherein said tracking screw gear rotates responsive to rotation of said handle assembly.

4. The hose reel cart in accordance with claim 3 wherein said tracking assembly includes, two idler gears rotatably secured, suitably spaced and horizontally positioned within said side wall member for interlocking engagement with respect to each other, said handle gear and said tracking screw gear to be rotatable responsive to rotation thereof, wherein said tracking screw gear rotates responsive to rotation of said handle.

5. The hose reel cart in accordance with claim 1 wherein said spool gear is larger in diameter than said handle gear to cause said spool gear to rotate at a rotational speed less than the rotational speed of said handle gear.

6. The hose reel cart in accordance with claim 1 wherein at least one of said pair of side wall members further includes an inner cover releasably secured thereto; wherein said inner cover structurally supports and encloses said gear train within said at least one wall member.

7. In a hose cart wherein said hose cart includes a reel for take up and pay out of a flexible elongate member, said reel including a longitudinal centerline defining an axis of rotation, a tracking assembly for said flexible elongate member comprising:

a double helix tracking screw, said double helix tracking screw suitably supported and journaled for rotation with respect to said hose cart;

a stabilizing rod suitably supported substantially parallel to and spaced apart from said reel axis of rotation and said double helix tracking screw;

a tracker body defining a hose guide, said tracker body constructed and arranged to cooperate with said double helix tracking screw and said stabilizing rod, wherein said tracker body is manually disengageable from said tracking screw and manually re-engageable to said tracking screw;

a tracking assembly gear train, said tracking assembly gear train constructed and arranged to transfer rotary motion from said reel to said double helix tracking screw, said tracking assembly gear train including at least one idler gear;

wherein when engaged said tracker body reciprocates back and forth across said tracking screw and said stabilizing rod in response to rotation of said hose reel to uniformly and smoothly wrap said flexible elongate member on said reel for a compact storage configuration, wherein when disengaged said flexible elongate member can be manually pulled from said reel without reciprocation of said tracker body and said tracker body is repositionable and re-engageable to said tracking screw.

8. The tracking assembly in accordance with 7, wherein said tracker body is constructed and arranged for automatic disengagement, wherein said tracker body disengages said tracking screw thereby preventing said tracker body from traversing said tracking screw in the event the tracker body path becomes obstructed, wherein said tracker body is repositionable and re-engageable with respect to said tracking screw.

9. The tracking assembly in accordance with claim 7, wherein said tracker body includes a tracking screw guide flange, wherein said tracking screw guide flange is constructed and arranged to cooperate with said tracking screw to provide lateral guiding of said tracker body.

10. The tracking assembly in accordance with claim 7, wherein said tracker body includes a stabilizer rod guide flange, wherein said stabilizer rod guide flange is constructed and arranged to cooperate with said guide rod to prevent rotation of said tracker body.

11. The tracking assembly in accordance with claim 7, wherein said tracker body includes a tracker follower removably and pivotally secured to said tracker body, wherein said tracker follower is constructed and arranged to cooperate with said tracking screw double helix to provide lateral reciprocating movement of said tracker body along said tracking screw.

12. The tracking assembly in accordance with claim 11, wherein said tracker follower includes a tracking foot, wherein said tracking foot is constructed and arranged to engage said double helix of said tracking screw.

13. The tracking assembly in accordance with claim 11, wherein said tracker follower includes a handle, wherein said handle is selectively positionable to directionally control lateral movement of said tracker body.

14. The tracking assembly in accordance with claim 11, wherein said tracker follower is removable from said tracker body, wherein removing said tracker follower from said tracker body disengages said tracker body from said double helix of said tracking screw, whereby said tracker body may freely traverse said tracking screw, wherein said tracker body is repositionable and said tracker follower is re-engageable with respect to said tracking screw.

* * * * *